United States Patent [19]

Feldt

[11] Patent Number: 4,545,085

[45] Date of Patent: Oct. 8, 1985

[54] WHEELED STRUCTURE FOR SUPPORTING A PATIENT IN A SITTING POSITION

[75] Inventor: Mats Feldt, Liatorp, Sweden

[73] Assignee: Landstingens Inkopscentral LIC, Solna, Sweden

[21] Appl. No.: 600,830

[22] Filed: Apr. 16, 1984

[30] Foreign Application Priority Data

Apr. 20, 1983 [SE] Sweden ..... 8302229

[51] Int. Cl.[4] ..... A61G 7/10

[52] U.S. Cl. ..... 5/81 R; 5/86; 180/209; 280/755

[58] Field of Search ..... 5/81 R, 81 B, 83, 86, 5/87, 88; 414/921; 4/560–566; 180/209; 280/755

[56] References Cited

U.S. PATENT DOCUMENTS

| | | | |
|---|---|---|---|
| 2,539,346 | 1/1951 | Feist | 5/86 |
| 2,595,651 | 5/1952 | Feist | 5/86 |
| 2,903,238 | 9/1959 | Flandrick | 5/86 |
| 2,962,730 | 12/1960 | Carnes et al. | 5/86 |
| 3,623,169 | 6/1969 | James | 5/81 R |
| 3,694,829 | 10/1972 | Bakker | 5/81 R |
| 3,940,808 | 3/1976 | Petrini | 5/81 R |
| 4,157,593 | 6/1979 | Kristensson | 5/81 R |

FOREIGN PATENT DOCUMENTS

| | | |
|---|---|---|
| 312399 | 7/1969 | Sweden . |
| 364635 | 3/1974 | Sweden . |

*Primary Examiner*—Alexander Grosz
*Attorney, Agent, or Firm*—Young & Thompson

[57] ABSTRACT

The invention relates to a wheeled structure for supporting a patient in a sitting position with the aid of raisable and lowerable arrangements designed for lifting a patient from e.g. a chair, a wheelchair or other kind of seat and transferring the patient to any desired place while depositing the patient in a sitting position, the substructure having two longitudinal side members with carrier wheels. According to the invention, the side members are connected to the structure by means of pivotable link arms enabling adjustment of the side members into desired lateral positions for varying the width between the side members as required. When driving up towards a wheelchair for example the width must be greater, whereas driving in narrow spaces such as lavatories requires a minimum width.

2 Claims, 5 Drawing Figures

PRIOR ART

WHEELED STRUCTURE FOR SUPPORTING A PATIENT IN A SITTING POSITION

The present invention relates to a wheeled structure of the type disclosed in the preamble to the appended claim 1. Such structures are known e.g. from U.S. patent specifications Nos. 3,623,169, 3,694,829, 3,940,808 and 4,157,593.

With the structures in question, certain difficulties have sometimes arisen due to the lateral distance between the wheels normally being fixed. On one hand it may be desirable to have the wheels widely spaced apart laterally to maintain the stability of the structure when rolling it up towards a wheelchair or the like, and on the other hand a small width is preferred for enabling the structure to be rolled through relatively narrow passages, for example when transporting the patient into a toilet room. If this width is fixed, it must be a compromise. The U.S. Pat. No. 3,694,829 however discloses a device in which the side members together with the wheels are laterally adjustable for selectively increasing or reducing the width between the side members. In this way the desired functions have been accomplished. This known device is however relatively complicated and expensive, and is suitable only for a specific type of upper portion. The object of the present invention is to achieve a substantially simplified arrangement while obtaining the same result as with the known device, enabling simultaneously various types of upper structure portions to be mounted on the substructure according to the invention.

This is accomplished with a structure according to the invention which has the characterizing features set forth in the appended claims. By providing the structure with a base portion in the form of two short interconnected side members supporting the upper portion of the structure, and a pair of long side members connected to the short members by means of pivotable link arms and having link wheels at their ends, the width between the wheel-carrying long side members may be readily reset from a desired minimum width to a desired maximum width, or at any other width chosen therebetween.

A suitable embodiment of the inventive structure is illustrated in the accompanying drawings.

Figure 1:
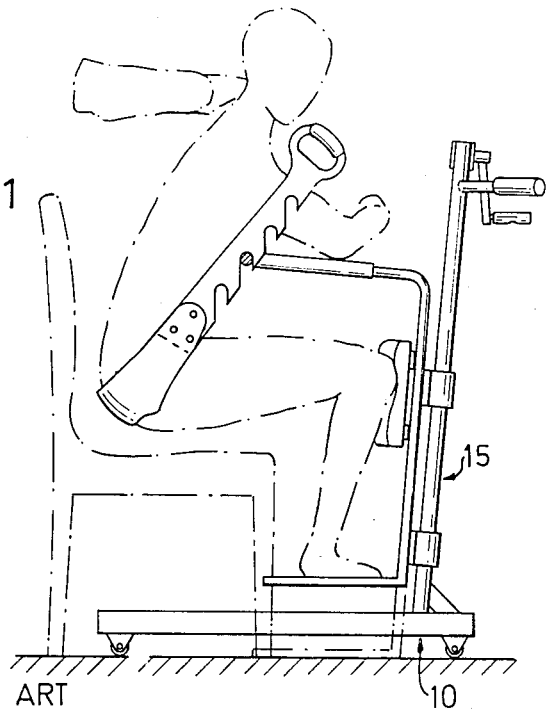
FIGS. 1 and 2 show schematically a conventional prior art structure in different working positions.
Figure 2:
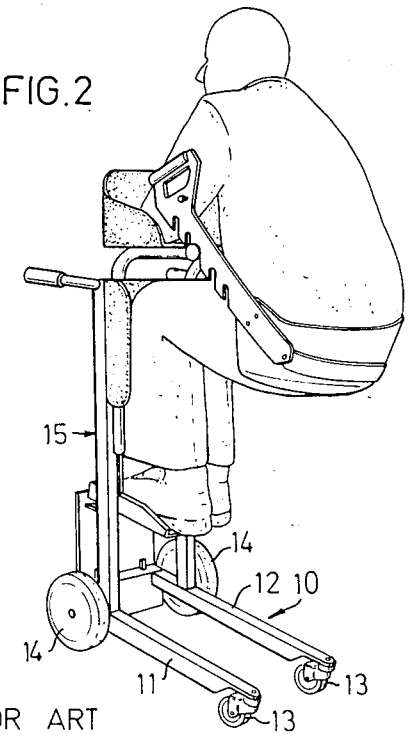
PRIOR ART FIG.2

The known structure according to FIGS. 1 and 2 has a base portion 10 with two fixed side members 11,12 provided with wheels 13,14. The upper portion is designated by the numeral 15.

Figure 3:
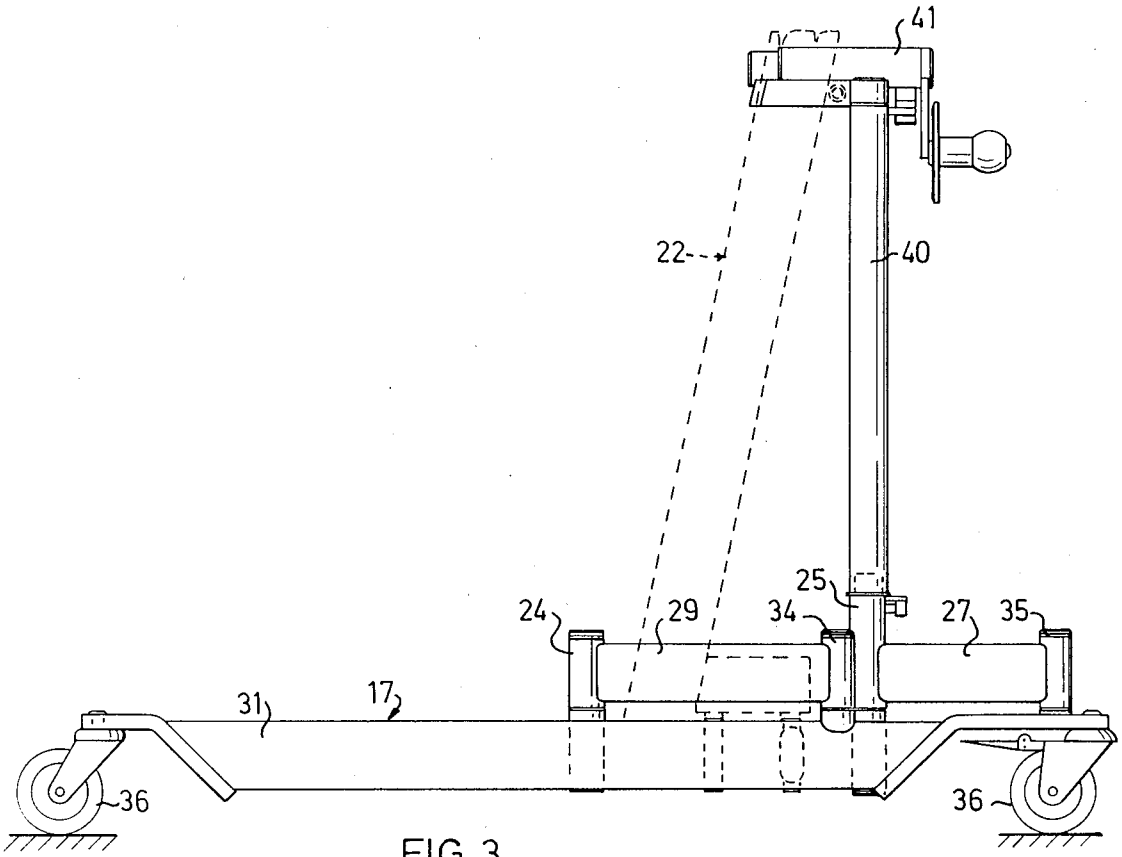
FIG. 3 is a side view of a separate substructure according to the invention.
Figure 4:
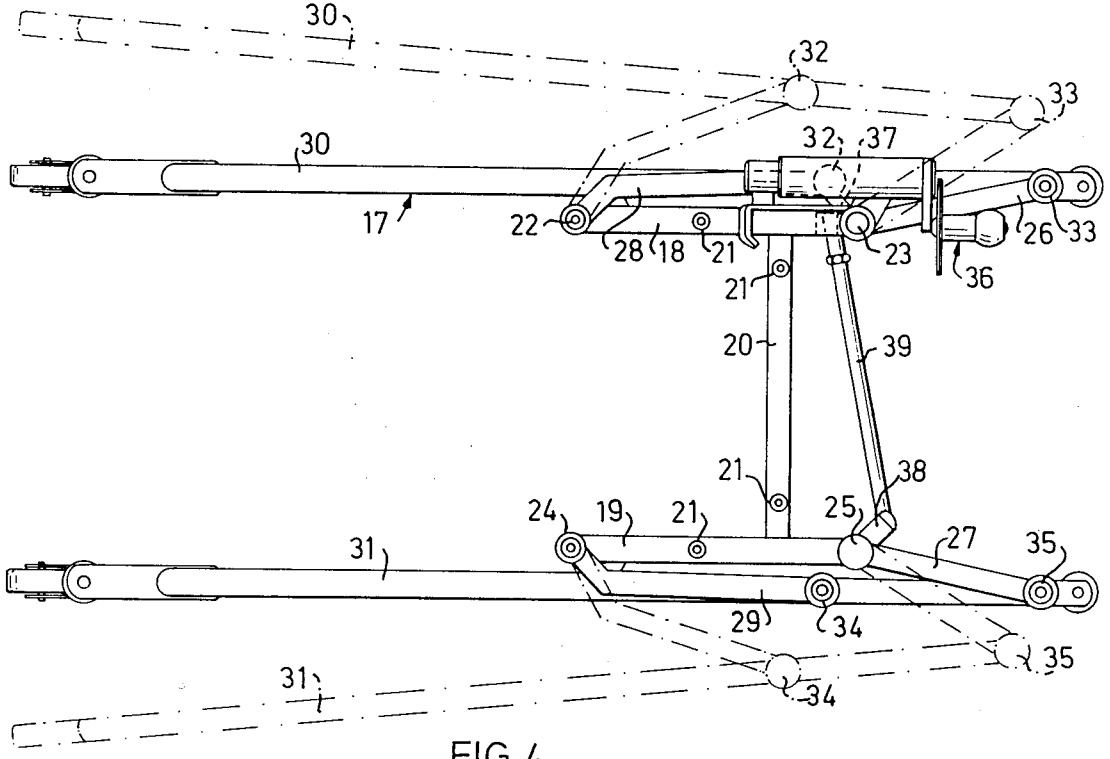
FIG. 4 shows this substructure seen from above.
Figure 5:
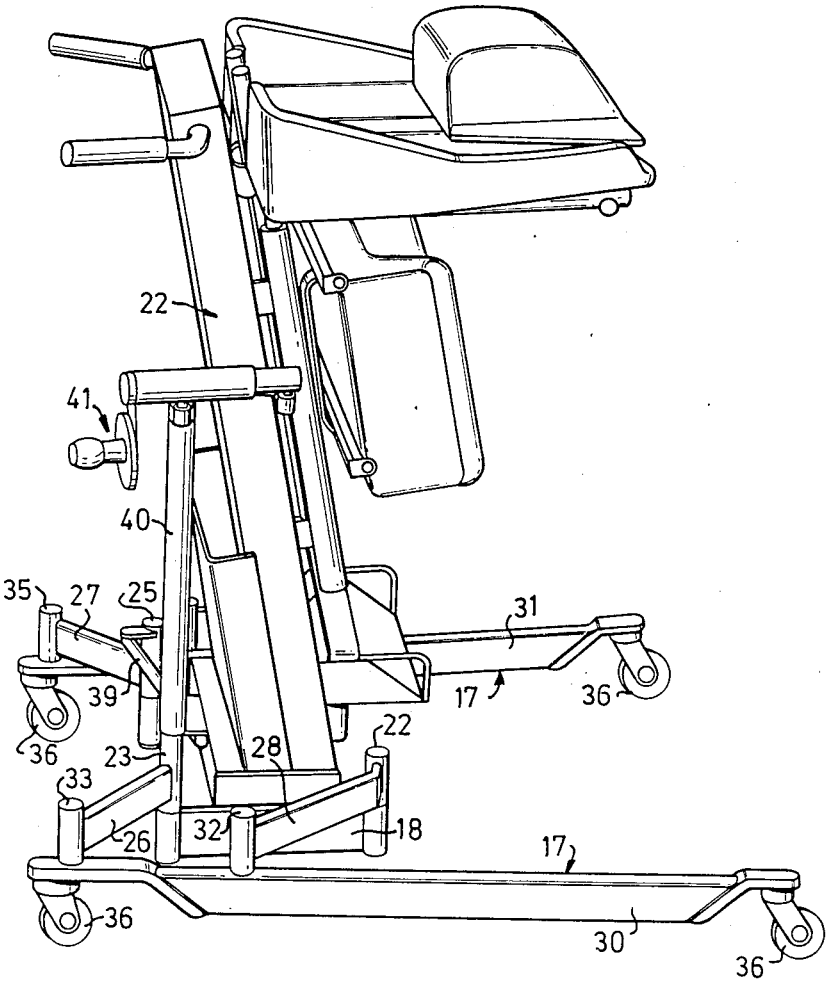
FIG. 5 is a schematic perspective view of the substructure provided with an embodiment of the upper portion.

The base portion 17 according to FIGS. 3 and 4 of the structure according to the invention is provided with two short side members 18,19 secured to each other by means of a cross piece 20. In the side members and the cross piece there are disposed bolt holes 21 for through-going mounting bolts enabling the attachment of various types of upper portions, e.g. an upper portion 22 of the embodiment schematically indicated in FIG. 5, designed in principle as the known embodiment illustrated in FIGS. 1 and 2 and described in the U.S. Pat. No. 4,157,593.

At the ends of the short side members there are vertical bearing bolts 22,23,24,25 for pivotally journalling a pair of rear link arms 26,27 and a pair of forward link arms 28,29. The outer ends of the link arms are pivotally connected to a pair of long side members 30,31 by means of vertical bearing bolts 32, 33,34,35.

The long side members 30,31 are provided at their ends with link wheels 36. As indicated in FIG. 4, the main portion of the long members 30,31 is disposed on one side of the cross piece 20, that is on the side where the patient will be seated when the patient is supported by the upper portion 22 according to FIG. 5.

FIG. 4 shows the long side members 30,31 in their innermost position affording the shortest distance between the long side members. In this figure also the long side members are indicated by dash-dotted lines in a folded-out position, which can be further extended by continued folding-out of the link arms as required, for example when the structure is to be used for moving a patient from a relatively wide chair such as a wheelchair.

The rear link arms 26,27 are shorter than the forward link arms 28,29 and therefore, when swinging out the link arms, the long side members will diverge resulting in an increased width between their free portions, that is in the area underneath the patient sitting in the upper portion of the structure. In this way the stability is improved thus counteracting lateral tipping. Furthermore, the structure is more easily rolled up towards a wheelchair for example, due to the facilitated directional setting of the long side members on either side of the wheelchair.

The bearing sleeves of the link arms 26,27 are provided with crankshafts 37,38 interconnected by a guide link 39. One sleeve is upwardly extended by means of a sleeve 40 to a crank mechanism 41 having a worm gear (not shown) for turning the sleeve 40 in one or the other direction, which causes the link arms 26,27 to swing outwards or inwards while laterally displacing the long side members for altering the width between them.

The inventive arrangement for varying the width between the wheels is thus designed in a simple as well as readily resettable manner.

What I claim is:

1. Wheeled structure for supporting a patient in a sitting position with the aid of raisable and lowerable arrangements designed for lifting a patient from e.g. a chair, a wheelchair or other kind of seat and for transferring the patient to any desired place while leaving the patient in a sitting position, the base portion of the structure having two substantially lateral side members close to the floor, the ends of these members being provided with carrier wheels and adjustable or movable into different lateral positions for varying the width between the side members, characterized in that a short longitudinal side arm is disposed at either side of the substructure, said side arms being rigidly attached to each other for a fixed distance between them, and laterally adjustable long side members which are connected to the respective adjacent short side member via a pair of link arms for resetting the position of the long members by pivoting the link arms around vertical pivot shafts; and in that one pair of link arms disposed at one end of the substructure has mutually equal length but different length in relation to the other pair of link arms in such a way that the long side members when extended will diverge so that the width between them is greatest in the area above which the patient is seated.

2. Structure as claimed in claim 1, characterized in that the link arms on one side are coupled together with the link arms on the other side by means of a guide link extending between a pivot shaft on one side to a pivot shaft on the other side and is connected to the respective pivot shaft via a crankshaft fixed thereto, so that the two long side members are simultaneously displaced outwards or inwards, one pivot shaft being upwardly extended and rotatable by means of a crank or the like.

* * * * *